United States Patent [19]

Kleefeldt

[11] Patent Number: 4,735,447

[45] Date of Patent: Apr. 5, 1988

[54] THREE-PART VEHICLE-DOOR LATCH

[75] Inventor: Frank Kleefeldt, Heiligenhaus, Fed. Rep. of Germany

[73] Assignee: Kiekert GmbH & Co. Kommanditgesellschaft, Heiligenhaus, Fed. Rep. of Germany

[21] Appl. No.: 888,148

[22] Filed: Jul. 18, 1986

[30] Foreign Application Priority Data

Jul. 24, 1985 [DE] Fed. Rep. of Germany ..... 3526501

[51] Int. Cl.[4] ..... E05C 3/26

[52] U.S. Cl. ..... 292/216; 292/201

[58] Field of Search ..... 292/216, 337, 280, DIG. 64, 292/201, 144, 346

[56] References Cited

U.S. PATENT DOCUMENTS

| | | | |
|---|---|---|---|
| 3,620,560 | 11/1971 | Peters | 292/201 |
| 3,971,239 | 7/1976 | Lavis | 292/337 X |
| 4,538,845 | 9/1985 | Yamada | 292/337 X |

*Primary Examiner*—Richard E. Moore

*Attorney, Agent, or Firm*—Karl F. Ross; Herbert Dubno

[57] ABSTRACT

A vehicle door latch for use in combination with a door bolt has an outer housing part formed with a recess in which the bolt is receivable and provided with a latch fork pivotal between a locked position securing the bolt in the recess and an unlocked position permitting the bolt to enter and exit the recess and with a latch pawl pivotal on the outer housing part into and out of a position retaining the fork in the locked position. A middle housing part lying on the outer housing part carries a releasing mechanism connected to the pawl for moving same into and out of its position retaining the fork in the locked position, a locking mechanism connected to the releasing mechanism for preventing same from operating the pawl to release the fork, and locking and opening levers respectively connected to the locking and releasing mechanisms and connectable respectively to the outside door lock and outside door handle for operating the respective mechanisms. An inner housing part lying on the middle housing part carries respective locking and opening links connected to the locking and releasing mechanisms for operating same and a servomotor connected to the locking mechanism for operating same and preventing operation of the releasing mechanism by the opening link and lever. Fasteners secure the parts to contain the mechanisms and servomotor.

6 Claims, 7 Drawing Sheets

THREE-PART VEHICLE-DOOR LATCH

FIELD OF THE INVENTION

The present invention relates to a vehicle door latch. More particularly this invention concerns such a latch which is part of an electric central-locking system.

BACKGROUND OF THE INVENTION

A standard door latch mounted on an outer door edge has a latching mechanism comprised mainly of a fork that can in a locked position engage around a jamb-mounted bolt and hold the door closed, and that can in an unlocked position release this bolt. The latching mechanism also normally has a pawl that is used to block the fork in the locked position, the fork being spring-loaded to move into the unlocked position when released by this pawl.

This pawl in turn can be moved by a release mechanism connected to an inside door handle or an outside door handle. Normally the outside handle acts against a lever on the latch and the inside handle is connected to its mechanism by a rod. The release mechanism itself is typically a lever system.

The standard door latch also is provided with a lock mechanism preventing the handles from acting on the pawl and allowing it to release the fork. This lock mechanism therefore comprises elements connected to the release mechanism and decoupling the handles from the pawl, so that when locked the handles can be operated but will do nothing.

A further feature now commonly seen is a device that allows all of the lock mechanisms to be operated centrally, typically by operation of the driver's door lock. Such an arrangement is frequently a retrofit, and merely is the provision of a servomotor in the door connected to the inside-lock control element. Thus this servomotor just duplicates the action of a person operating the inside-lock element.

These latches are fairly complicated and, as a result, expensive to manufacture and service. In the event of any failure of the latch it must normally be replaced in its entirety.

A disadvantage of the central-system latches is that a skilled thief can often open the door by reaching inside it to act on the linkage between the inside lock element and the release mechanism. The mechanism around the servomotor is particularly susceptible to such tampering. Such a lock system therefore frequently represents a loss in security.

OBJECTS OF THE INVENTION

It is therefore an object of the present invention to provide an improved vehicle door latch.

Another object is the provision of such a vehicle door latch which, while being used in a central-lock system, overcomes the above-given disadvantages, that is which effectively resists manipulation of the release mechanism.

SUMMARY OF THE INVENTION

A vehicle door latch for use in combination with a door bolt according to the invention has an outer housing part formed with a recess in which the bolt is receivable and provided with a latch fork pivotal between a locked position securing the bolt in the recess and an unlocked position permitting the bolt to enter and exit the recess and with a latch pawl pivotal on the outer housing part into and out of a position retaining the fork in the locked position. A middle housing part lying on the outer housing part carries a releasing mechanism connected to the pawl for moving same into and out of its position retaining the fork in the locked position, locking mechanism connected to the releasing mechanism for preventing same from operating the pawl to release the fork, and locking and opening levers respectively connected to the locking and releasing mechanism connectable respectively to the outside door lock and outside door handle for operating the respective mechanisms. An inner housing part lying on the middle housing part carries respective locking and opening links connected to the locking and releasing mechanisms for operating same and a servomotor connected to the locking mechanism for operating same and preventing operation of the releasing mechanism by the opening link and lever. Fasteners secure the parts together with the middle part between the inner and outer parts and all three parts forming a closed housing containing the mechanisms and servomotor.

Thus the system has a wholly closed housing whose individual parts carry independent subassemblies that together make up a lock. The servomotor is completely enclosed in the housing, that is no sides of this housing are open so that a would-be car thief can slide in a tool and operate the servomotor mechanism.

According to another feature of this invention respective connecting rods operatively are connected between the links and the respective inside door handle and lock. The inner part is formed with pockets and the rods having ends engaging in the pockets with the respective links. Thus even though these rods extend into the housing, there are no holes in the housing through which access could be had to the releasing mechanism.

In accordance with another feature of this invention the outer part is of metal and the inner and middle parts are of plastic. Thus construction is extremely inexpensive but robust.

To further prevent unauthorized operating of the latch the inner part has webs forming the pockets and the links are wholly within the inner part. Thus access to the releasing mechanism is denied by these webs. In addition the links have lobes and the inner part is formed with seats normally complementarily and snugly receiving the lobes.

DESCRIPTION OF THE DRAWING

The above and other features and advantages will become more readily apparent from the following, reference being made to the accompanying drawing in which.

SPECIFIC DESCRIPTION

Figure 7:
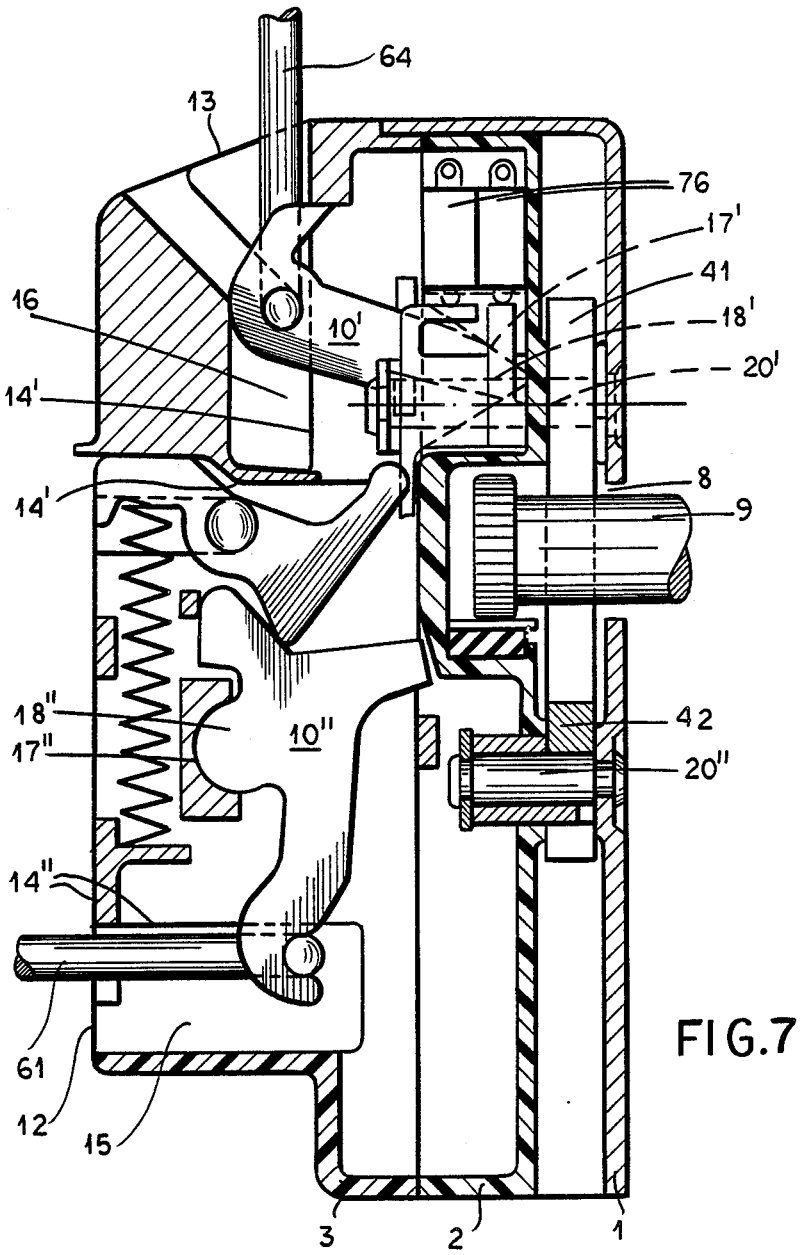
FIG. 7 is a section through the entire latch taken along line VII—VII of FIG. 3.

As seen in FIGS. 1 through 4, a vehicle door latch usable on any style of motor vehicle has a housing 1, 2, 3 formed of a metal outer part 1, a plastic middle part 2, and a plastic inner part 3. The outer and middle parts 1 and 2 are secured with their respective mechanisms to the inside face of the door edge by screws passing through registering holes 11 in the two parts 1 and 2, and the part 3 is secured to the part 2 via screws 5 passing through holes 23 in the part 3. The respective door jamb carries a lock bolt 9 (FIGS. 5 and 7 only).

Figure 5:
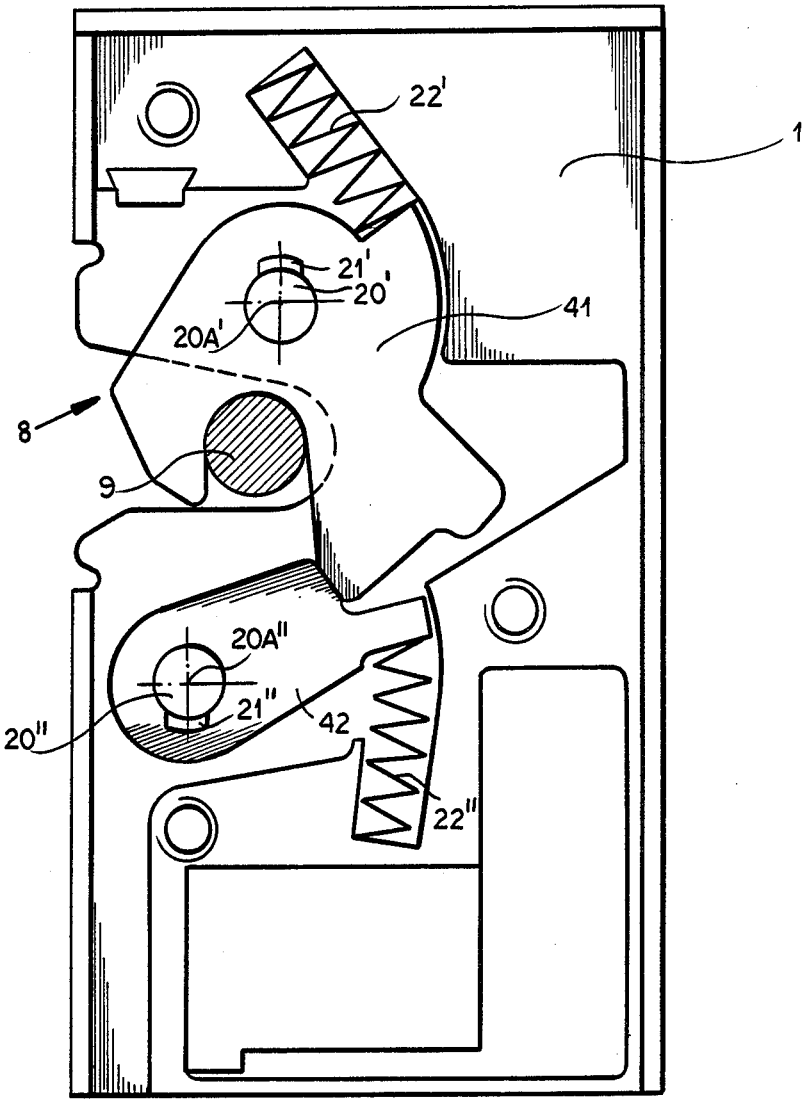
FIG. 5 is a large-scale view of the outside latch subassembly seen from inside.

The outer part 1 as best seen in FIG. 5 is formed with an outwardly open notch or cutout 8 into which the bolt 9 can engage and carries a standard lock fork 41 pivoted on a pin 20′ centered on an axis 20A′ and formed offset from this axis 20A′ with an axially inwardly open recess 21′. A spring 22′ urges this fork 41 into a position releasing the bolt 9. A lock pawl 42 carried on a pin 20″ centered on an axis 20A″ and formed offset from this axis 20A″ with an axially inwardly open recess 21″ can engage against the fork 41 in the manner well known in the art to retain it against the force of its spring 22 in the locked position, thereby capturing and retaining the bolt 9. A spring 22′ urges this pawl 42 into engagement with the fork 41. Thus this outer housing part 1, which is as mentioned above ruggedly made of metal, carries the mechanism responsible for retaining the bolt 9.

Figure 1:
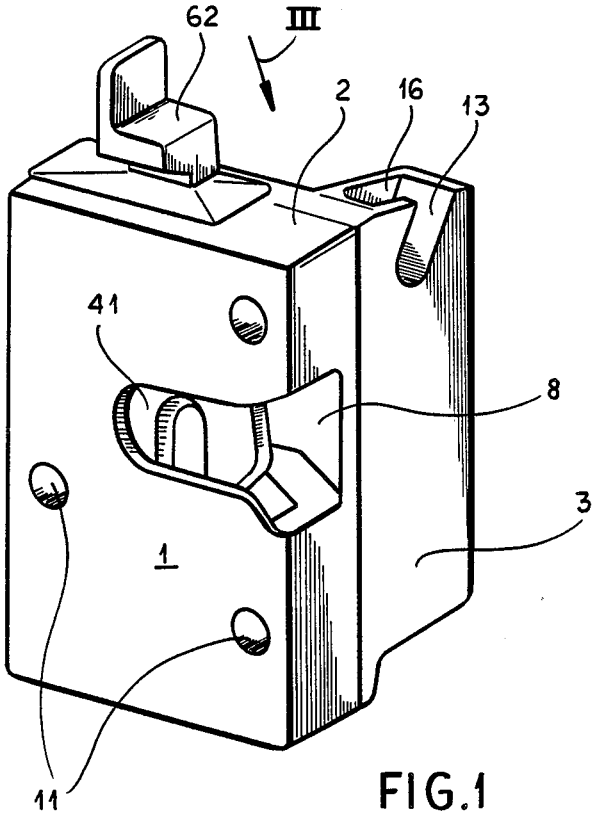
FIG. 1 is a perspective view of the latch according to this invention seen from outside.
Figure 2:
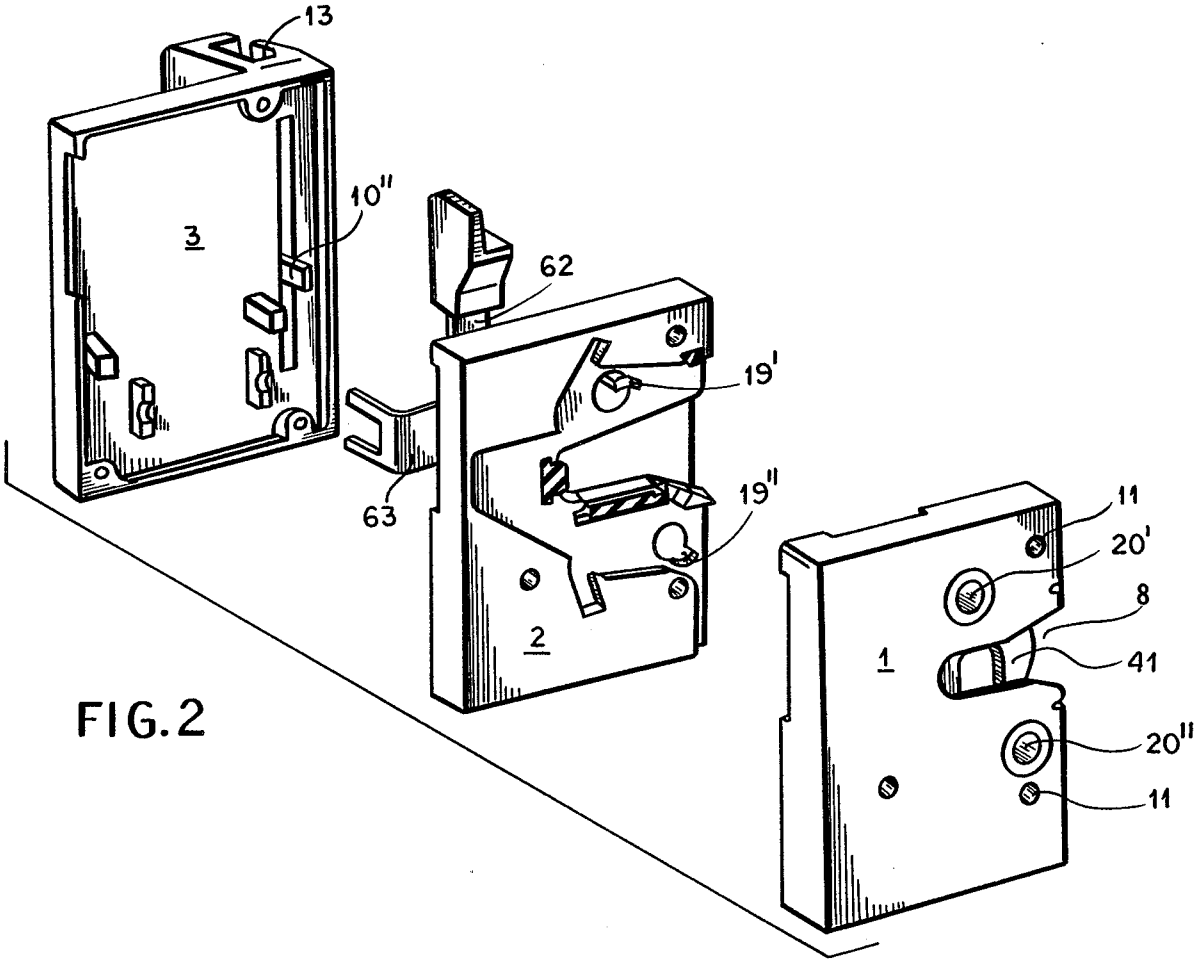
FIG. 2 is an exploded view of the latch showing its main subassemblies seen from outside also.
Figure 3:
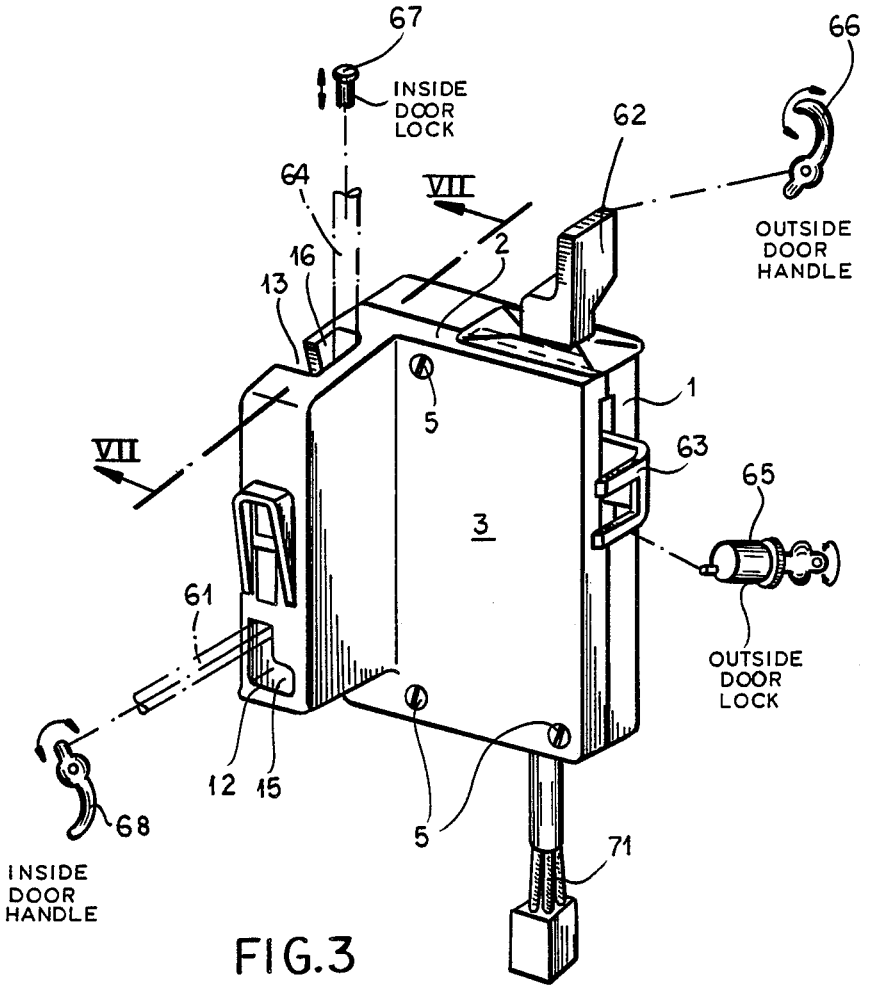
FIG. 3 is a perspective view of the latch of this invention, but taken from the inside as indicated by arrow III of FIG. 1.
Figure 4:
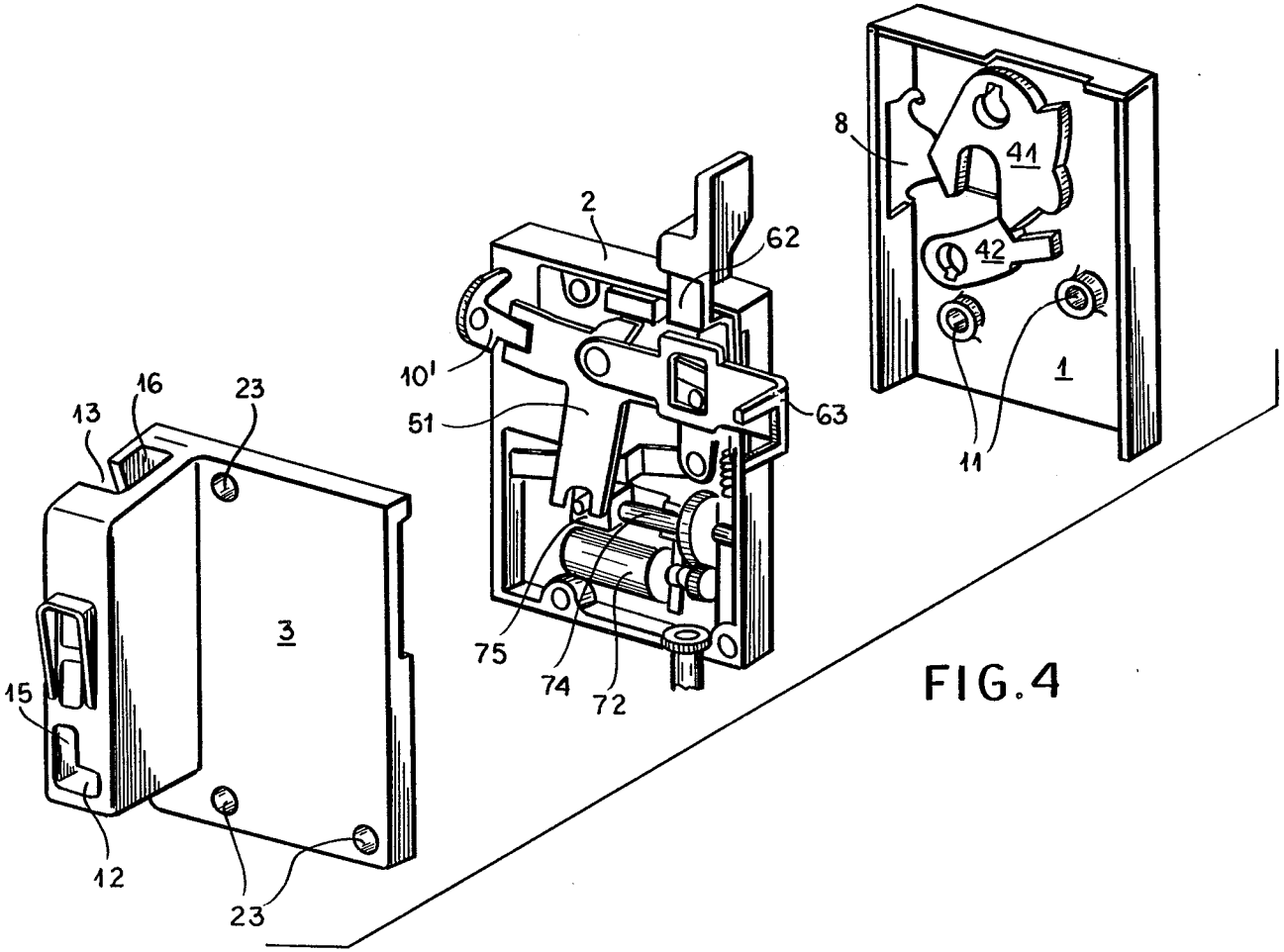
FIG. 4 is an exploded view of the latch seen from inside as in FIG. 3.
Figure 6:
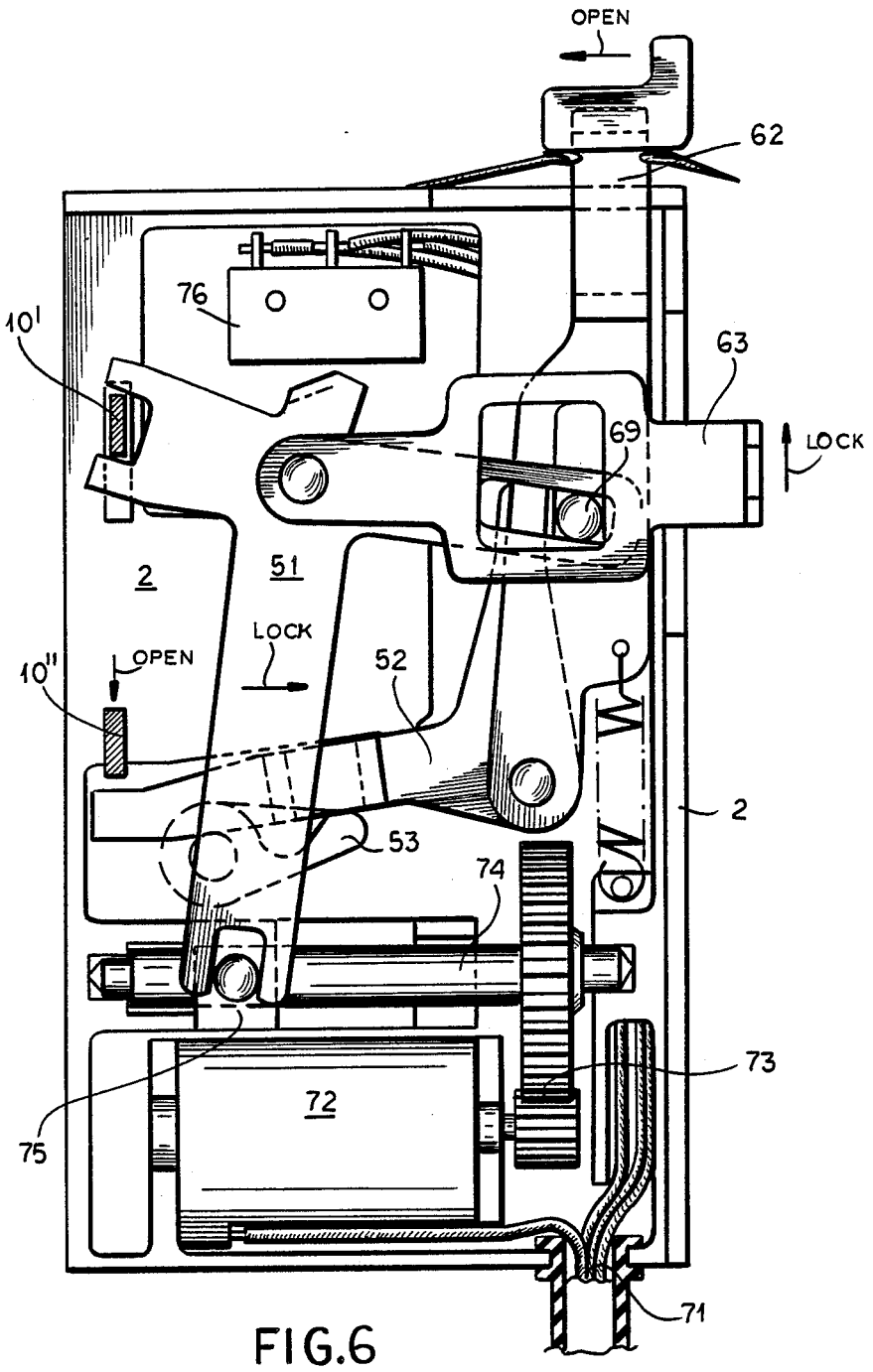
FIG. 6 is a large-scale view of the middle latch subassembly seen from inside and with some of the parts of the inner subassembly seen in section.

The middle housing part 2 as best seen in FIG. 6 and as illustrated schematically in FIG. 3 has a locking mechanism 63 that is connected to the outside door lock 65 (FIG. 3) and a releasing mechanism 62 connected to the outside door handle 66 (FIG. 3). Furthermore this part 2 carries locking lever 51 connected as described below to the inside door lock button 67 and an opening lever 52 connected to the inside door handle 68 and bearing on a further lever 53. The interaction of these parts is standard, mainly facilitated by a pin 69 that can be moved by either the inside door button 67 or the outside door lock 65 into a position coupling the levers 52 and 62 to off center pins 19′ and 19″ respectively fittable in the recesses 21′ and 21″ to operate the fork 41 and pawl 42, which is operatively connected with lever 53 or into a position decoupled therefrom with the vehicle door locked. The middle part 2 therefore carries all of the mechanism coupling the lock and handle on the outside of the door to the latching mechanism of the outer part 1.

In addition according to this invention the middle part 2 carries a small rotary electric motor 72 connected via gearing 73 to a threaded shaft 74 carrying a nut 75 coupled to the lock lever 51. This servomotor 72 forms part of an electric central lock system allowing the doors to be moved into and out of the locked position. In addition switches 76 are provided to monitor the positions of the mechanism, and these switches 76 are connected with the motor 72 via a cable 71 that passes down out of the middle part 2. This motor 72 is clamped between the middle part 2 and outer part 1 so that it can be replaced relatively easily.

The inner housing part 23 has a lateral extension normally extending parallel to the inner face of the door (that is in the travel direction and vertically) and is formed with an inwardly open pocket 15 and with an upwardly open pocket 16 having respective open ends 12 and 13 into which extend L-rods 61 and 64 respectively connected to the inside door handle 68 and inside door lock 67. Respective locking and opening links 10′ and 10″ are fitted to the bent-over inner ends of these rods 61 and 64 and extend through the inner part 3 to the middle part 2 where as shown in FIG. 6 they can act on the levers 51 and 52 responsible for respectively opening and locking the door. The pockets 15 and 16 have internal webs 14′ and 14″ that impart such a shape to the pockets 15 and 16 that the respective rods 64 and 61 can be inserted and pivoted through 90° to lock the respective links 10″ and 10′. Furthermore the inner part 3 is formed with seats 17′ and 17″ for lobes 18′ and 18″ of the levers 10′ and 10″ and of such a complementary interfit that they define stable end positions for these links 10′ and 10″. Thus all of the parts connected to the inside door elements—the lock button 67 and handle 68—are carried on the inner part 3.

The lock of the instant invention therefore comprises three discrete subassemblies. This makes manufacturing it fairly easy, and also greatly facilitates installation and servicing. What is more, the servomotor 72 and its drive mechanism 73–75 for central locking of the door are completely enclosed in the housing 1, 2, 3, making it virtually impossible to pop open the lock by use of a standard "slim Jim" type of break-in appliance, that is a thin bar with a notched end.

I claim:

1. A vehicle door latch comprising:

a door bolt;

an outside door lock;

an outside door handle;

an outer housing part formed with a recess in which the bolt is receivable;

a latch fork pivotal on the outer housing part between a locked position securing the bolt in the recess and an unlocked position permitting the bolt to enter and exit the recess;

a latch pawl pivotal on the outer housing part into and out of a position retaining the fork in the locked position;

a middle housing part lying on the outer housing part;

means including a releasing mechanism on the middle housing part connected to the pawl for moving same into and out of its position retaining the fork in the locked position;

means including a locking mechanism on the middle housing part connected to the releasing mechanism for preventing same from operating the pawl to release the fork;

locking and opening levers on the middle housing part respectively connected to the locking and releasing mechanisms which are connectable respectively to the outside door lock and the outside door handle for operating the respective mechanisms;

an inner housing part lying on the middle housing part;

respective locking and opening links on the inner housing part connected to the locking and releasing mechanisms for operating same;

means including a servomotor on the middle housing part connected to the locking mechanism for operating same and preventing operation of the releasing mechanism by the opening link and lever; and fasteners securing the parts together with the middle part between the inner and outer parts and all three parts forming a closed housing containing the mechanisms and servomotor.

2. The vehicle latch defined in claim 1, further comprising:

an inside door handle;

an inside door lock; and respective connecting rods operatively connected between the links and the respective handle and lock, the inner part being formed with pockets and the rods having ends engaging in the pockets with the respective links.

3. The vehicle latch defined in claim 2 wherein the outer part is of metal.

4. The vehicle latch defined in claim 3 wherein the inner and middle parts are of plastic.

5. The vehicle latch defined in claim 2 wherein the inner part has webs forming the pockets and the links are wholly within the inner part.

6. The vehicle latch defined in claim 5 wherein the links have lobes and the inner part is formed with seats normally complementarily and snugly receiving the lobes.

* * * * *